US005967682A

United States Patent [19]

Tanahashi

[11] Patent Number: 5,967,682

[45] Date of Patent: Oct. 19, 1999

[54] RECORDER

[75] Inventor: Naokazu Tanahashi, Nagoya, Japan

[73] Assignee: Brother Kogyo Kabushiki Kaisha, Nagoya, Japan

[21] Appl. No.: 09/078,568

[22] Filed: May 14, 1998

[30] Foreign Application Priority Data

May 15, 1997 [JP] Japan ..... 9-125831

[51] Int. Cl.[6] ..... B41J 29/02

[52] U.S. Cl. ..... 400/693; 400/691

[58] Field of Search ..... 400/693, 691, 400/692, 685, 680, 679

[56] References Cited

U.S. PATENT DOCUMENTS

| | | | |
|---|---|---|---|
| 4,895,231 | 1/1990 | Yamaguchi et al. | 400/691 |
| 5,186,557 | 2/1993 | Fushimi | 400/693 |
| 5,475,413 | 12/1995 | Hashimoto et al. | 400/680 |
| 5,482,391 | 1/1996 | Cook | 400/691 |
| 5,499,043 | 3/1996 | Osaka | 400/691 |
| 5,646,872 | 7/1997 | Yonenaga et al. | 400/680 |

FOREIGN PATENT DOCUMENTS

| | | | |
|---|---|---|---|
| 405193216 | 8/1993 | Japan | 400/691 |

*Primary Examiner*—Edgar Burr
*Assistant Examiner*—Anthony H. Nguyen
*Attorney, Agent, or Firm*—Oliff & Berridge, PLC

[57] ABSTRACT

A recorder includes a housing and a key entry area, which is adjacent to the front end of the housing. The recorder also includes a recording unit for recording on a sheet of paper. The distance between the front end of the housing and the recording unit is equal to or longer than the length between the top of a cut sheet of letter size and the bottom of the print area in the cut sheet of letter size. The recorder further includes a tray fitted to the bottom of the housing to receive a sheet of paper fed from the recording unit. At least while the recorder is recording on a cut sheet of letter size being fed to the recording unit, the front end of the sheet does not protrude, through the space between the housing and the tray, from the front end of the housing. If the sheet end protruded, it would interfere with the operator's key entry operation.

17 Claims, 4 Drawing Sheets

RECORDER

BACKGROUND OF THE INVENTION

1. Field of the Invention

The present invention relates to a recorder for recording or printing characters on a paper sheet, and more particularly to a portable word processor or electronic typewriter.

2. Description of Related Art

FIG. 5 of the accompanying drawings shows a conventional portable word processor 100, which includes a housing 101. Keys are arranged in a key entry area 102, which is formed at the top of a front portion of the housing 101. A display unit 103 includes a liquid crystal panel for displaying the characters entered through the area 102, etc., and is supported pivotably on the housing 101. While the processor 100 is used, as shown in FIG. 5, the display unit 103 can be held in an open position in the rear of the entry area 102. While the processor 100 is carried, the display unit 103 can be closed over the entry area 102. A print unit 104 is supported in the housing 101. A feed tray 105 is positioned in the rear of the display unit 103, and supported pivotably on the housing 101. While the processor 100 is used, the tray 105 can be held in a backwardly inclined position relative to the top of the housing 101, as shown in FIG. 5. The tray 105 in this position can be stacked with cut sheets of paper, which can be fed toward the print unit 104. The tray 105 can also be held in a closed position on the top of the housing 101.

If a sheet printed at the print unit 104 made a U-turn to be discharged in front of the feed tray 105, it would be curved forcedly and become curly.

As shown in FIG. 5, discharge rollers 106 and a discharge port 108 are positioned in a lower portion of the housing 101. A horizontal discharge tray 107 is fitted to the bottom of the housing 101. The printed sheet P is discharged forward through the port 108 and between the housing 101 and the tray 107.

The discharge port 108 is positioned under the key entry area 102. The horizontal distance D between the port 108 and the front end of the housing 101 is shorter than the length of an ordinary cut sheet of paper. Therefore, the front end of an ordinary cut sheet printed and discharged onto the tray 107 protrudes from the front end of the housing 101 so that the sheet can be taken out easily from the tray 107. The sheet end may protrude even while the sheet is printed.

At the same time that the operator is entering characters at the entry area 102, a sheet of paper might be printed and discharged. In this case, however, the front end of the discharged sheet P might strike against the operator's wrists. It is therefore impossible in practice to perform printing and key entry in parallel by using the word processor 100.

SUMMARY OF THE INVENTION

It is an object of the invention to provide a recorder into which key entry can be made even while the recorder is printing a sheet of paper.

In accordance with the invention, a recorder is provided, which includes a housing. A key entry area is formed at the top of the housing and adjacent to the front end of the housing. A recording unit is supported in the housing to record on a sheet of paper. The distance between the front end of the housing and the recording unit is equal to or longer than the length between the top of a sheet of paper of letter size and the bottom of the print area in the sheet of paper of letter size. A tray is fitted to the bottom of the housing to receive a sheet of paper fed from the recording unit.

A cut sheet of paper of letter size has a length of 11 inches or 279.4 mm. A sheet of this size may be fed lengthwise to the recording unit, from which the sheet is sent onto the tray. The sheet on the tray is discharged from the front end of the housing. In this case, while part of the sheet is positioned at the recording unit, that is, at least while the recorder is recording on the sheet, the front end of the sheet moving on the tray is prevented from protruding from the front end of the housing. Therefore, even while the recorder is recording or printing, the front end of the sheet being discharged does not interfere with the operator's key entry. This makes it possible to perform recording and key entry at the same time, thereby making the word processing and the printing efficient.

The distance between the one end of the housing and the recording unit may be equal to or longer than the length of the sheet of paper of letter size.

A size A4 cut sheet of paper is 297 mm in length. In general, the bottom margin of a cut sheet is set at about 1 inch or 2.54 mm or more. A size A4 cut sheet can be printed lengthwise by this recorder while maintaining the effect of the invention. In this case, likewise, while the sheet is printed, its front end does not protrude from the front end of the housing.

In the inventive recorder, the distance between the one end of the housing and the recording unit may have a sufficient length to prevent the front end of the sheet of paper of letter size discharged on the tray from protruding from the one end of housing. Thereby, even after recording is completed, the front end of the sheet being discharged does not interfere with the operator's key entry. In order to realize the effect, for example, when the recorder includes a pair of discharge rollers which discharge the sheet of paper onto the tray and which are provided downstream from the recording unit, a distance between the one end of housing and the discharge rollers may be equal to or longer than the length of the sheet of paper of letter size.

The recording unit may include an ink jet head having one or more nozzles. The distance between the front end of the housing and the nozzle or the central position of the nozzles may be equal to or longer than the length of a sheet of paper of letter size.

The recorder may also includes a sheet feeder supported on the housing and adjacent to the rear end of the housing. The housing may have a discharge port formed in its bottom to discharge through it a sheet of paper fed from the recording unit. The discharge port may be positioned between the key entry area and the feeder.

The recorder may further include a carrying handle supported pivotably on the bottom of the housing. The housing bottom may have a cavity formed on its outside, into which the handle can pivot for engagement with the cavity. The tray may have a recess cut in it, through which the handle can pivot for engagement with the housing cavity. This makes it convenient to carry the recorder, and prevents the tray from interfering with the handle pivoting into the housing cavity.

The tray may have another recess cut in it so that a sheet of paper smaller than the size A4 can be picked from the tray. Fingers of the operator can get access through this recess to the smaller sheet discharged on the tray. This makes it easy to pick the sheet from the tray. This recess may incline relative to the direction of sheet discharge. The edge of the inclined recess is less liable to catch the side edges of the sheet. Therefore, the sheet can be discharged onto and taken from the tray smoothly.

The recorder may have the function of processing words, and be an electronic typewriter or a word processor.

BRIEF DESCRIPTION OF THE DRAWINGS

A preferred embodiment of the invention will be described with reference to the accompanying drawings, in which.

DETAILED DESCRIPTION OF A PREFERRED EMBODIMENT

Figure 1:
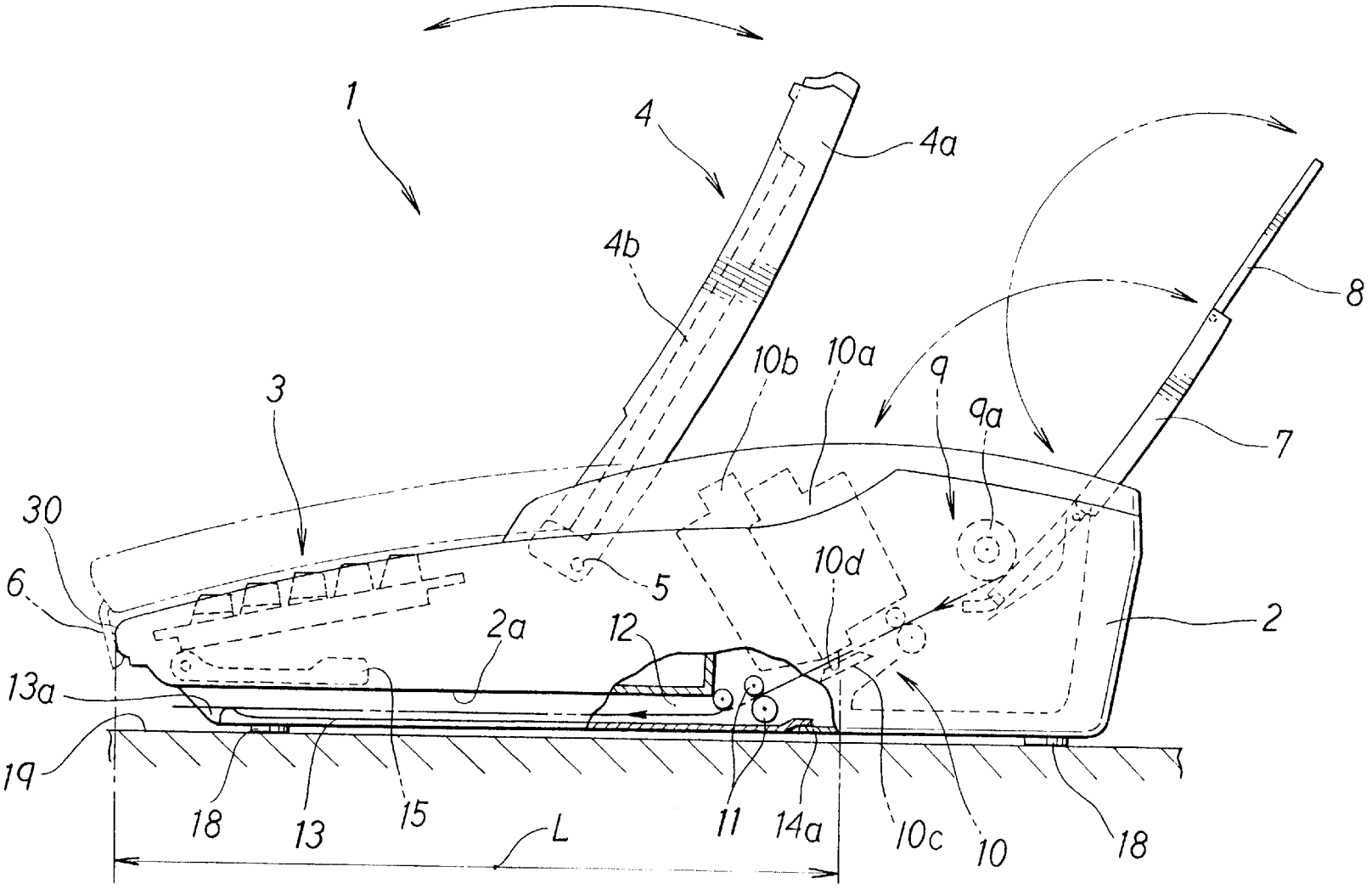
FIG. 1 is a partially broken side view of a portable word processor according to the embodiment.

With reference to FIG. 1, a portable word processor 1 embodying the invention includes a housing 2, which may be made of synthetic resin. Various keys are arranged in a key entry area 3, which is formed at the top of a front portion of the housing 2.

A display unit 4 includes a liquid crystal display 4*b*. The back of the display 4*b* is covered with a cover 4*a*, which may be made of synthetic resin. The display unit 4 is supported pivotably through a horizontal shaft 5 by the housing 2 in the rear of the entry area 3. While the word processor 1 is used, the display unit 4 can be kept open in a backwardly inclined position as shown with solid lines in FIG. 1. While the processor 1 is not used or is carried, the display unit 4 can be closed with its display 4*b* positioned over the entry area 3 and protected by the cover 4*a*, as shown with two-dot chain lines in FIG. 1. The free end of the display unit 4 can be fastened through a hook 6 to the front end of the housing 2.

A main feed tray 7 is positioned in the rear of the display unit 4, and supported pivotably on a horizontal axis by the rear end of the top of the housing 2. The tray 7 can be stacked with cut sheets of paper in an inclined position. An auxiliary feed tray 8 is supported pivotably on a horizontal axis by the free end of the main tray 7. While the word processor 1 is used, as shown in FIG. 1, the trays 7 and 8 can be held in backwardly inclined and erected positions at the same angle. The auxiliary tray 8 can be held selectively in the erected position or a folded position on the main tray 7.

Figure 4:
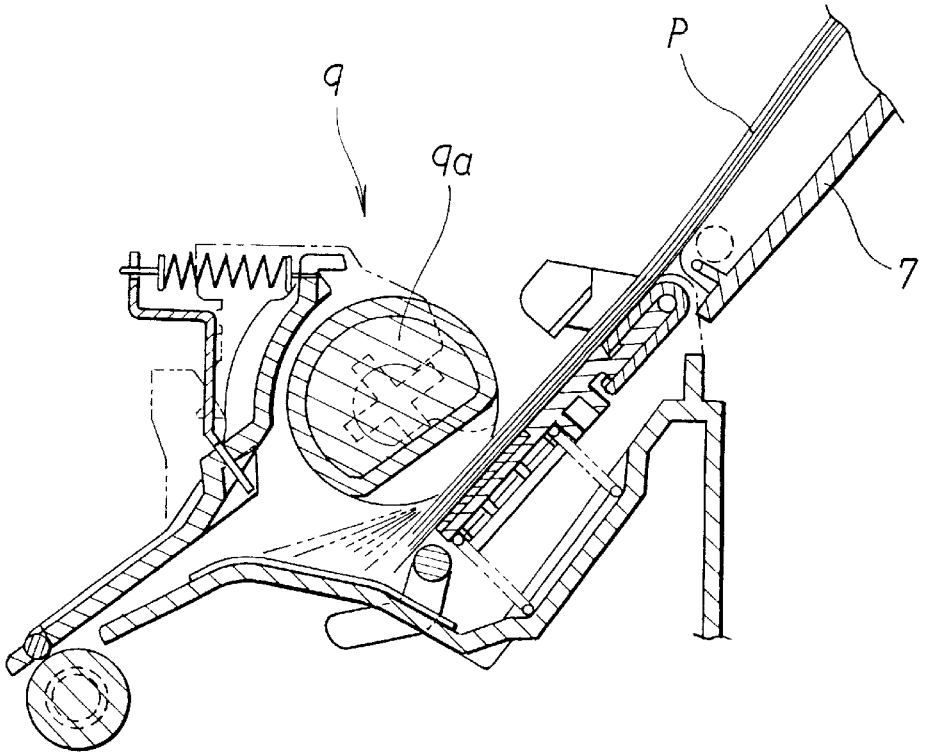
FIG. 4 is a vertical section of the sheet feeder of the word processor.
Figure 5:
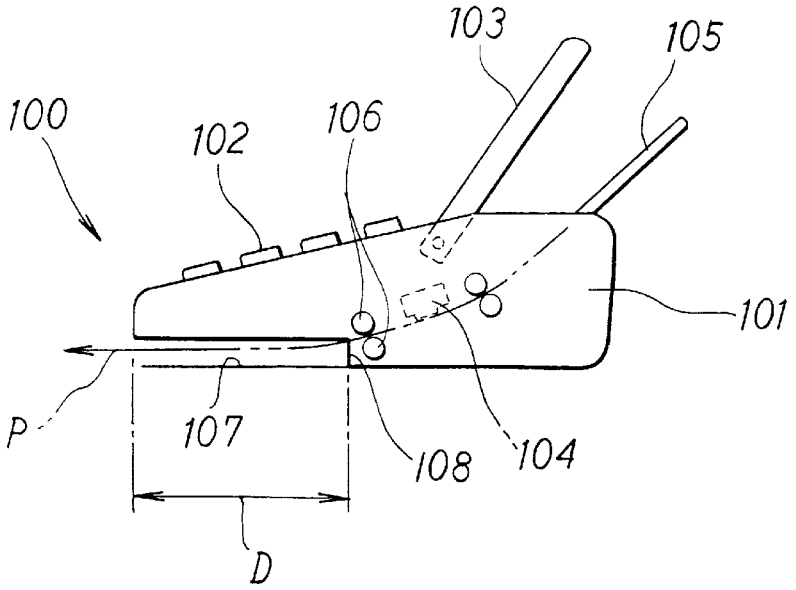
Fig. 5 PRIOR ART
FIG. 5 is a schematic side view of a conventional word processor.

A sheet feeder 9 is installed in the housing 2. As shown in FIG. 4, the feeder 9 includes semi-cylindrical feed rollers 9*a* supported below and in front of the main feed tray 7.

A print unit 10 is positioned downstream from, or in front of, the feeder 9. The unit 10 includes a print head 10*a* having an ink jet nozzle 10*d*. The head 10*a* is mounted on a carriage 10*b*, and can print a sheet of paper moving between the head and a platen 10*c*.

Discharge rollers 11 and a discharge port 12 are positioned below the print unit 10 and in the rear of the pivotal end of the display unit 4.

A flat discharge tray 13 extends horizontally between a position near the discharge rollers 11 and a position near the front end 30 of the housing 2. The front end 13*a* of the tray 13 might be positioned under the housing end 30, and may be positioned substantially under the front end of the key entry area 3. The tray 13 is spaced suitably from a bottom surface 2*a* of the housing 2.

The horizontal distance L between the front end 30 of the housing 2 and the ink jet nozzle 10*d* is slightly longer than the length of a cut sheet of letter size. The sheet length is 11 inches (279.4 mm), and the distance L is about 288 mm. Therefore, until the rear end (trailing edge) of the sheet passes the ink jet nozzle 10*d*, the front end (leading edge) of the sheet does not protrude from the front end 30 of the housing 2.

In general, the bottom margin of a cut sheet is set at about 1 inch. Therefore, the front end of even a size A4 cut sheet does not protrude from the front end 30 of the housing 2, at least while the sheet is printed, that is, until the bottom of the printed area in the sheet passes the ink jet nozzle 10*d*.

The front end 13*a* of the discharge tray 13 is curved upward. Therefore, even if a front end portion of a discharged sheet protrudes slightly from the tray end 13*a*, it does not contact the table 19 on which the word processor 1 is put. This makes it easy for the operator to pick the sheet from the tray 13.

Figure 2:
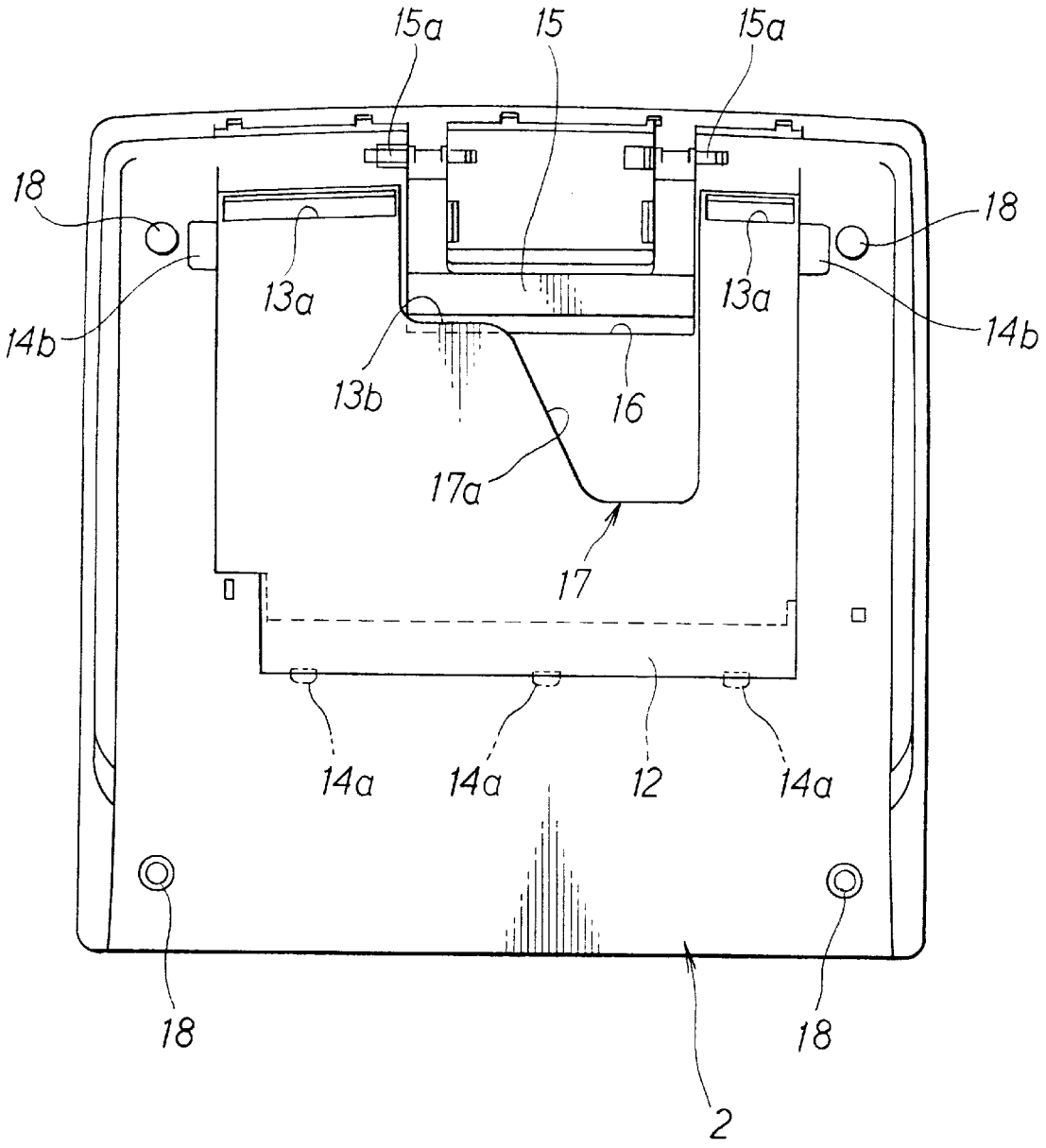
FIG. 2 is a bottom view of the word processor shown in FIG. 1.
Figure 3:
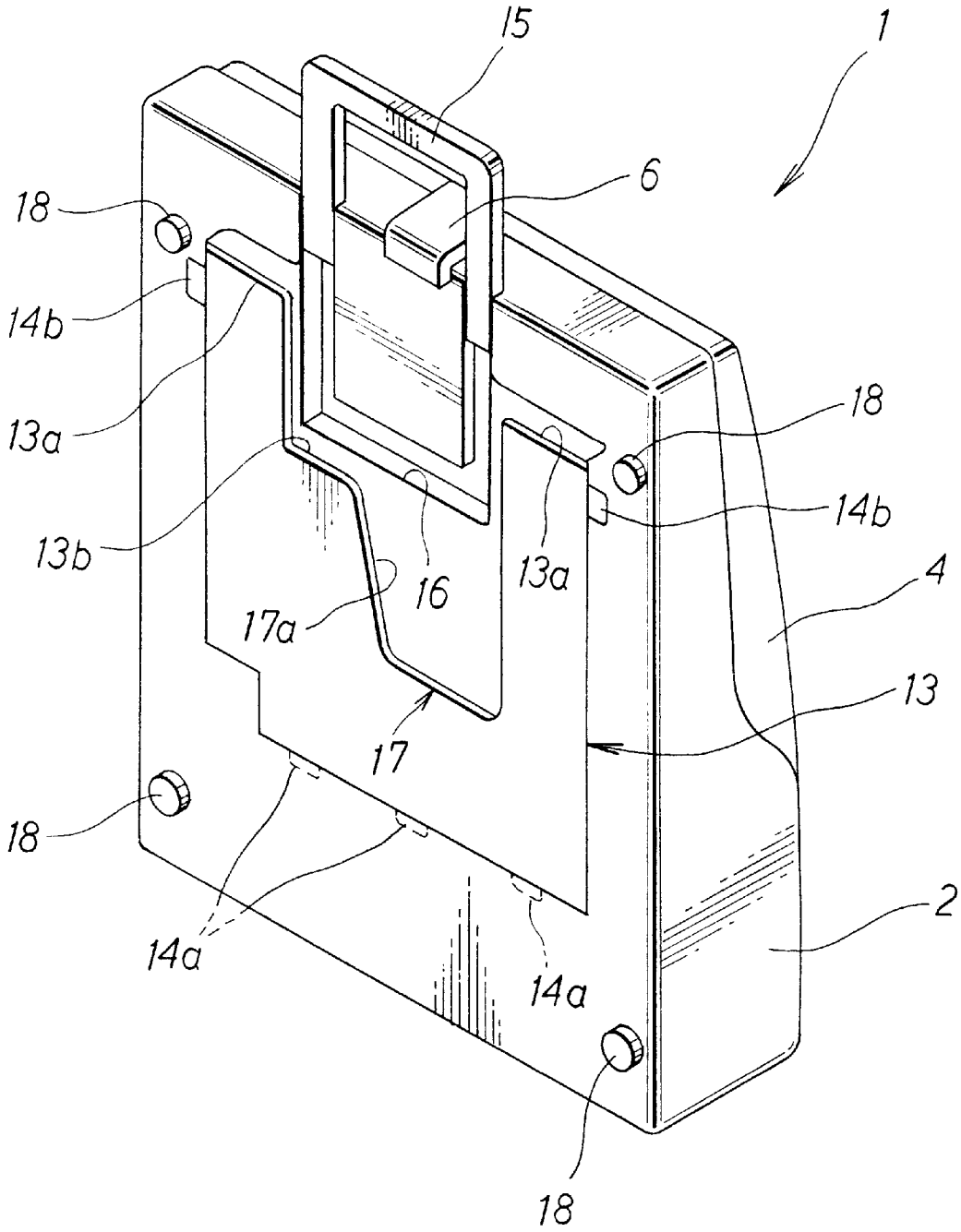
FIG. 3 is a perspective view of the word processor shown in FIG. 1, but with the handle out.

As shown in FIGS. 1, 2 and 3, the discharge tray 13 has hooks 14*a* and 14*b* formed on its rear end and side edges. The hooks 14*a* and 14*b* engage removably with the bottom of the housing 2.

A carrying handle 15 includes a horizontal or intermediate bar and a pair of arms each extending from one end of the bar. The other ends 15*a* of the arms are supported rotatably by the bottom of the front end of the housing 2. The housing 2 has a groove or cavity 16 formed in its bottom for engagement with the handle 15. When positioned in the groove 16, the handle 15 does not interfere with a sheet of paper being discharged.

As shown in FIGS. 2 and 3, the discharge tray 13 has a recess 13*b* cut in its front end portion in order for the tray not to interfere with the handle 15 pivoting into and out of the groove 16. The tray 13 has a narrower recess 17 extending backward from the recess 13*b* in order for the tray not to interfere with fingers of the operator directly picking the front end of a sheet of small size on the tray 13. The small sheet may be a post card. The right (left in FIG. 2) edge 17*a* of the narrower recess 17 inclines with respect to the direction of sheet movement. It is preferable that the left side of the feed tray 7 be the reference side for cut sheets of paper. Otherwise, both edges of the recess 17 might incline. Consequently, when a cut sheet of small size is discharged, it can be received on the discharge tray 13, without its right edge caught by the inclined edge 17*a* of the recess 17.

The housing 2 has feet 18 formed on its bottom to space the discharge tray 13 from the table 19. This prevents the tray 13 from being pressed and bent by the table 19.

For key entry in the word processor 1 on the table 19, the operator opens the display unit 4 as shown in FIG. 1, and turns on the power switch (not shown). The operator can then enter characters with keys in the entry area 3, with his or her wrists resting on the table 19.

For printing, the operator erects the feed trays 7 and 8 as shown in FIG. 1, and stacks sheets of paper on them. The stacked sheets can be separated one by one by the semi-cylindrical feed rollers 9*a* etc. and fed one after one to the position between the print head 10*a* and platen 10*c*. The printed sheets are discharged by the discharge rollers 11 through the discharge port 12 onto the discharge tray 13. If a cut sheet being discharged is of ordinary size (for example, A4 or letter size), its front end does not protrude from the front end 30 of the housing 2 while it is printed. In this case, the sheet being discharged does not interfere with the operator's wrists on the table 19, while he or she is working with keys in the entry area 3. It is therefore possible to perform key entry and printing in parallel by using the word processor 1.

Although the invention has been described hereinbefore in detail with reference to the drawings, it is not limited to the illustrated structure and size. Without departing from the spirit of the invention, various modifications and improvements may be made within the scope of the appended claims. 185

As stated already, the horizontal distance L between the front end 30 of the housing 2 and the ink jet nozzle 10*d* is slightly longer than the length of a sheet of letter size. Otherwise, the distance L might be sufficiently longer to prevent the front end of a sheet of letter size discharged on the tray 13 from protruding from the housing end 30. Specifically, the horizontal distance between the housing end 30 and the discharge roller set 11 might be longer than 11 inches.

What is claimed is:

1. A recorder comprising:

a housing;

a key entry area formed at the top of the housing, the entry area being adjacent to one end of the housing;

a recording unit supported in the housing for recording on a sheet of paper, the recording unit being away from the one end of the housing by a distance which is at least equal to the length between the top of a sheet of paper of letter size and the bottom of a print area in the sheet of paper of letter size; and a discharge tray fitted to the bottom of the housing for receiving a sheet of paper fed from the recording unit, a front end of the discharge tray on the one end of the housing being open allowing removal of the sheet of paper from the front end.

2. The recorder as defined in claim 1, wherein the distance between the one end of the housing and the recording unit is at least equal to the length of the sheet of paper of letter size.

3. The recorder as defined in claim 1, wherein the recording unit includes an ink jet head having a nozzle, the nozzle being away from the one end of the housing by a distance which is at least equal to the length of the sheet of letter size.

4. The recorder as defined in claim 1, and further comprising a sheet feeder supported on the housing, the feeder being adjacent to the other end of the housing, the housing having a discharge port formed in the bottom thereof for discharging therethrough a sheet of paper fed from the recording unit.

5. The recorder as defined in claim 4, wherein the discharge port is positioned between the key entry area and the sheet feeder.

6. The recorder as defined in claim 1, and further comprising a carrying handle supported pivotably on the bottom of the housing, the housing bottom having a cavity formed on the outside thereof, into which the handle can pivot for engagement with the cavity.

7. The recorder as defined in claim 6, wherein the tray has a recess cut therein, through which the handle can pivot for engagement with the cavity.

8. The recorder as defined in claim 1, wherein the tray has a recess cut therein so that a sheet of paper smaller than the size A4 can be picked from the tray.

9. The recorder as defined in claim 8, wherein the recess inclines relatively to the direction of sheet discharge.

10. The recorder as defined in claim 1, wherein the front end of the tray, from which a sheet of paper can be taken out, is curved upward.

11. The recorder as defined in claim 1, wherein the recorder has the function of processing words.

12. The recorder as defined in claim 11, wherein the recorder is an electronic typewriter.

13. The recorder as defined in claim 11, wherein the recorder is a word processor.

14. The recorder as defined in claim 11, and further comprising a display which can open and close to cover the key entry area.

15. The recorder as defined in claim 1, wherein the distance between the one end of the housing and the recording unit is at least equal to the length between the top of a size A4 sheet of paper and the bottom of the print area in the size A4 sheet.

16. The recorder as defined in claim 1, wherein the distance between the one end of the housing and the recording unit has a sufficient length to prevent the front end of the sheet of paper of letter size discharged on the tray from protruding from the one end of housing.

17. The recorder as defined in claim 1, and further comprising a pair of discharge rollers which discharge the sheet of paper onto the tray and which are provided downstream from the recording unit, wherein a distance between the one end of housing and the discharge rollers is at least equal to the length of the sheet of paper of letter size.

* * * * *